US008479708B2

(12) United States Patent
Allen et al.

(10) Patent No.: US 8,479,708 B2
(45) Date of Patent: Jul. 9, 2013

(54) INTERNAL COMBUSTION ENGINE WITH A FUEL INJECTION SYSTEM

(75) Inventors: Jeffrey Allen, Norfolk (GB); Paul Bartholomew Ravenhill, Norfolk (GB); Steven Barraclough, Norfolk (GB); Richard Matthew Hoolahan, Norfolk (GB)

(73) Assignee: Robert Bosch GmbH, Stuttgart (DE)

( * ) Notice: Subject to any disclaimer, the term of this patent is extended or adjusted under 35 U.S.C. 154(b) by 593 days.

(21) Appl. No.: 12/678,055

(22) PCT Filed: Sep. 12, 2008

(86) PCT No.: PCT/GB2008/003096

§ 371 (c)(1),
(2), (4) Date: Mar. 12, 2010

(87) PCT Pub. No.: WO2009/034338

PCT Pub. Date: Mar. 19, 2009

(65) Prior Publication Data

US 2010/0212635 A1 Aug. 26, 2010

(30) Foreign Application Priority Data

Sep. 14, 2007 (GB) ..... 0718016.9

(51) Int. Cl.
*F02M 55/02* (2006.01)
*F02M 37/20* (2006.01)

(52) U.S. Cl.
USPC ..... 123/468; 123/470; 123/516

(58) Field of Classification Search
USPC ..... 123/456, 468, 469, 470, 472, 514, 123/516, 518, 519, 520; 137/587, 588
See application file for complete search history.

(56) References Cited

U.S. PATENT DOCUMENTS 3,789,819 A * 2/1974 Moulds ..... 123/516
3,937,195 A 2/1976 Woods
4,416,238 A * 11/1983 Knapp et al. ..... 123/470

(Continued)

FOREIGN PATENT DOCUMENTS

CN 2303085 Y 1/1999
CN 1414239 A 4/2003

(Continued)

OTHER PUBLICATIONS

Patents Act 1977: Search Report under Section 17—Date of Search: Oct. 19, 2005 Application No. GB0516235.9 (2 pages).

(Continued)

*Primary Examiner* — Thomas Moulis
(74) *Attorney, Agent, or Firm* — Luedeka Neely Group, PC

(57) ABSTRACT

With reference to FIG. 1, the present invention provides, an internal combustion engine comprising a variable volume combustion chamber (10); an air intake passage (103,104) via which air is delivered to the combustion chamber (10); a fuel injector (107) delivering fuel into the air intake passage (103, 107); and a fuel storage tank (107) for storing fuel to be injected. The fuel injector (107) is at least in part immersed in fuel, the fuel injector (107) being located at least in part in a fuel chamber (108*b*) which is connected to or which forms part of the fuel storage tank (108). An escape path is provided for escape of fuel vapor from the fuel injector (107) and/or from the proximity of the fuel injector to the fuel storage tank (108).

21 Claims, 7 Drawing Sheets

U.S. PATENT DOCUMENTS

| | | | | |
|---|---|---|---|---|
| 4,499,878 | A | 2/1985 | Igashira et al. | |
| 4,589,381 | A * | 5/1986 | Takayama | 123/184.38 |
| 4,747,384 | A * | 5/1988 | Hafner et al. | 123/470 |
| 4,872,439 | A * | 10/1989 | Sonoda et al. | 123/519 |
| 5,027,780 | A * | 7/1991 | Uranishi et al. | 123/520 |
| 5,080,070 | A | 1/1992 | Hafner | |
| 5,095,876 | A * | 3/1992 | Yonekawa et al. | 123/468 |
| 5,471,962 | A * | 12/1995 | Nakashima et al. | 123/456 |
| 5,592,922 | A * | 1/1997 | Denz | 123/520 |
| 5,595,160 | A * | 1/1997 | Matsumoto et al. | 123/456 |
| 5,765,538 | A * | 6/1998 | Krimmer et al. | 123/516 |
| 6,341,597 | B1 * | 1/2002 | Cohen | 123/516 |
| 6,892,710 | B2 * | 5/2005 | Ekstam | 123/514 |
| 6,935,314 | B2 * | 8/2005 | Zdroik et al. | 123/456 |
| 7,111,616 | B2 * | 9/2006 | Oyamada et al. | 123/516 |
| 7,159,577 | B2 * | 1/2007 | Haskew et al. | 123/516 |
| 7,506,638 | B2 * | 3/2009 | Shinkarenko et al. | 123/514 |
| 7,591,248 | B2 * | 9/2009 | Mizui et al. | 123/468 |
| 2004/0020475 | A1 * | 2/2004 | Hashimoto et al. | 123/514 |
| 2008/0308331 | A1 * | 12/2008 | Trunkenpolz et al. | 180/68.3 |
| 2009/0298365 | A1 * | 12/2009 | Kato et al. | 440/88 F |

FOREIGN PATENT DOCUMENTS

| | | | |
|---|---|---|---|
| CN | 1777745 | A | 5/2006 |
| DE | 3705848 | A1 | 1/1988 |
| DE | 10014553 | A1 | 4/2001 |
| EP | 0 140 170 | A2 | 8/1985 |
| EP | 0 140 170 | A3 | 8/1985 |
| EP | 0200865 | A1 | 12/1986 |
| GB | 1138536 | | 1/1969 |
| GB | 2072261 | A | 9/1981 |
| GB | 2107784 | A | 5/1983 |
| GB | 2318388 | A | 4/1998 |
| GB | 2421543 | A | 6/2006 |
| JP | 59087238 | A | 5/1984 |
| JP | 60017250 | A | 1/1985 |
| WO | 2009/034338 | A2 | 3/2009 |

OTHER PUBLICATIONS

Text of the First Office Action (PCT Application Entering the National Phase of China); pp. 1-5.

* cited by examiner

INTERNAL COMBUSTION ENGINE WITH A FUEL INJECTION SYSTEM

CROSS-REFERENCE TO RELATED APPLICATION

This application claims priority under all applicable rules and statutes to International Application No. PCT/GB2008/003096, filed Sep. 12, 2008, and entitled INTERNAL COMBUSTION ENGINE WITH A FUEL INJECTION SYSTEM, which claims priority to GB 0718016.9, filed 14 Sep. 2007, incorporated herein by reference in their entireties.

The present invention relates to an internal combustion engine with a fuel injection system.

In GB2421543 the applicant has described a fuel injection system having a fuel injector which acts as a positive displacement pump and in each and every operation dispenses a set amount of fuel. In each engine cycle the total amount of fuel delivered to an engine is controlled not by the opening time of a valve (as is the case with typical pulse width modulation valves and their injection systems), but instead by the number of operations of the fuel injector in the engine cycle.

The fuel injection system of GB2421543 advantageously dispensed with the need for a high pressure fuel supply line, because the fuel injector itself functions as a pump. The injector was designed for use with small engines, such as those found in garden machinery, e.g. lawnmowers. Fuel could be supplied to the fuel injector by gravity feed.

A problem faced in all fuel-injected engines is the control of fluid vapour in the fuel injection system. Gasoline is a very volatile fluid, particularly when the gasoline involved is a fresh load of gasoline, which has higher ends which tend to evaporate first. The problem of fluid vapour is exacerbated in summer when the ambient temperatures are higher. Furthermore, recently blended fuels have been introduced which incorporate ethanol along with gasoline and these have enhanced the problems caused by vaporisation of fuel in the fuel injection system prior to delivery. The response of conventional fuel injection systems to the difficulty of fuel vaporisation has been to increase fuel supply pressure and thereby prevent vaporisation in the first place. However, this is not desirable for a small engine and instead it is preferable that the injector of GB 2421543 is used with a low pressure supply, such as a gravity feed supply.

The present invention provides an internal combustion engine comprising:

a variable volume combustion chamber;

an air intake passage via which air is delivered to the combustion chamber;

a fuel injector delivering fuel into the air intake passage; and a fuel storage tank for storing fuel to be injected; wherein:

the fuel injector is at least in part immersed in fuel, the fuel injector being located at least in part in a fuel chamber which is connected to or which forms part of the fuel storage tank; and an escape path is provided for escape of fuel vapour from the fuel injector and/or from the proximity of the fuel injector to the fuel storage tank.

The present invention avoids the problem of fuel evaporation by immersing the fuel injector in the fuel, e.g. at the bottom of a fuel tank. This has the supplemental benefit that the casing associated with the injector such as described in GB 2421543 is cut away and this minimises flow restrictions and improves injector efficiency.

Preferred embodiments of the present invention will now be described with reference to the accompanying drawings, in which.

Figure 1:
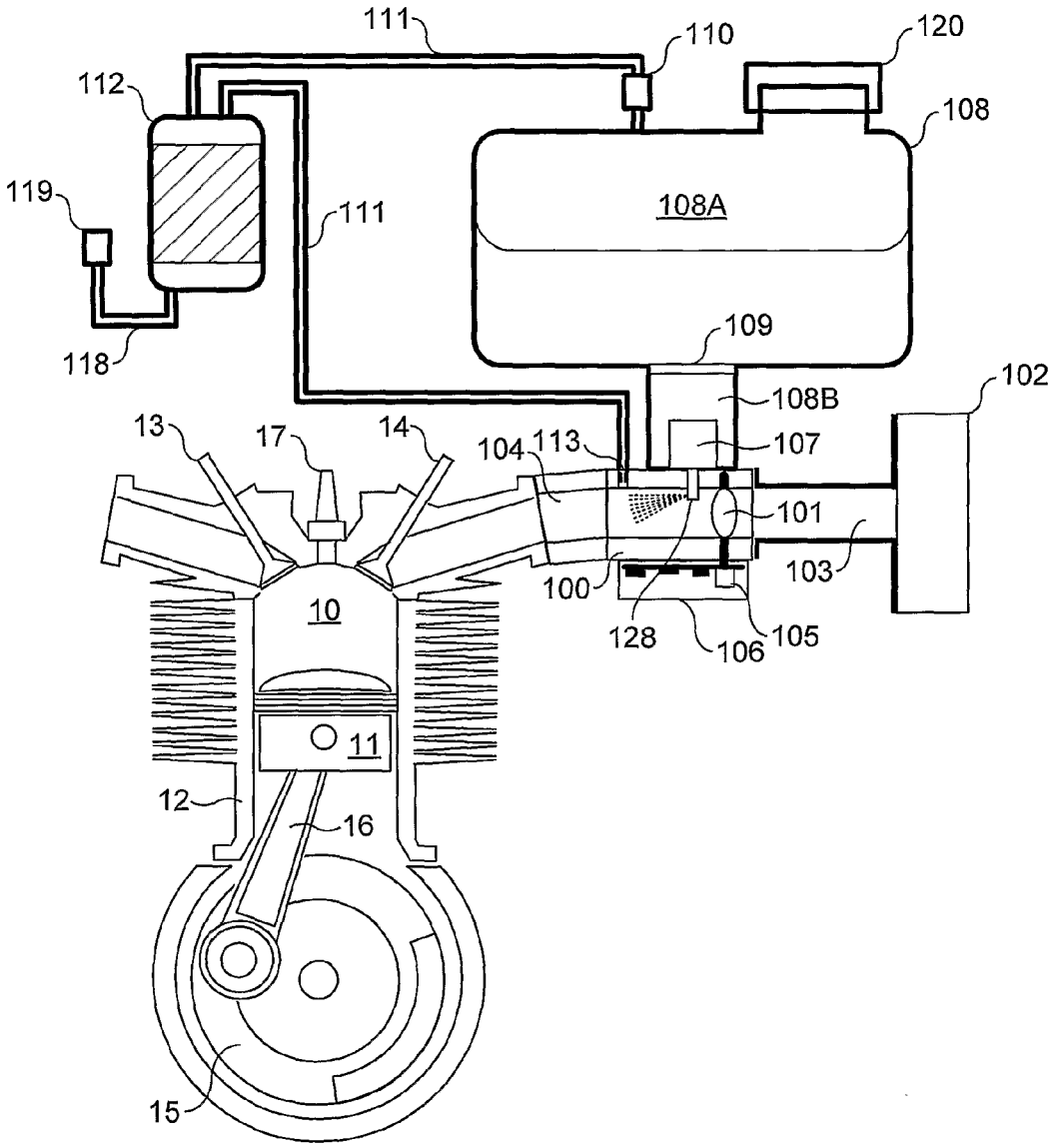
FIG. 1 is a schematic drawing of a first embodiment of internal combustion engine with fuel injection system according to the present invention.

Turning first to FIG. 1, this illustrates an internal combustion engine having a variable volume combustion chamber 10 formed by a piston 11 reciprocating in the cylinder formed in a cylinder block 12. A poppet valve 13 is an exhaust valve which controls flow of combusted gases from the combustion chamber 10. A poppet valve 14 is an intake valve which controls flow of fuel and air into the combustion chamber 10. The poppet valves 13 and 14 will be operated by cam shafts (not shown) which will be connected to a crankshaft 15 for rotation in timed relationship with the crankshaft 15. The piston 11 is connected to the crankshaft 15 by a connecting rod 16. The figure also shows a spark plug 17 mounted centrally in the cylinder head. In each of FIGS. 2, 3 and 4 the same internal combustion engine is shown and the same reference numerals are used for the same components. What differs between the figures is the fuel injection system used for the illustrated engines.

In FIG. 1 the fuel injection system can be seen to comprise a throttle body 100 in which a throttle 101 is mounted for rotation, the throttle 101 controlling flow of intake air to the combustion chamber 10. The intake air passes initially through an air filter 102 then along an intake passage part 103 to the throttle 100 and then onwardly via intake passage part 104 to the intake valve 14 and then, when intake valve 14 is open, to the combustion chamber 10.

Motion of the throttle 101 is sensed by a sensor 105. The sensor 105 provides a signal to an integrated electronic controller 106, this controller also receiving signals from other sensors (not shown) for e.g. detecting the position of the crankshaft 15 and ambient pressure within the passage through the throttle body 100.

A fuel injector 107 is controlled by the integrated electronic controller 106. The fuel injector 107 delivers fuel via a fuel delivery nozzle 128, the nozzle 128 extending vertically downwardly into the throttle body 100 from an upper part of the throttle body 100. The fuel injector 107 will be described in greater detail later in relation to FIG. 5.

The fuel injector 107 has a pumping portion which is fully immersed in the fuel provided in fuel tank 108. The fuel tank 108 has two parts, an upper part **108*a* of a first greatest volume and greatest cross-sectional area and a second lower part 108*b* of a smaller volume and smaller cross-sectional area. The two parts of the fuel tank 108 are separated by a fine gauge fuel filter 109 which prevents impurities passing from the fuel chamber upper part 108*a* to the fuel chamber lower part 108*b* and therefore prevents them passing to the fuel injector 107. The fuel tank 108 is sealed by a filling cap 120, which is removable to allow filling of the fuel tank 108**.

A build-up of pressure in the tank 108 is avoided by use of a purge line 111. A pressure release valve 110 is connected in the purge line 111 and when a threshold pressure (e.g. of 1 to 3 psi) is reached the valve 110 will open to allow fuel vapour to pass to a carbon canister 112. Carbon in the canister 112 absorbs the fuel vapour. The canister 112 is connected by a line 118 to atmosphere, with a filter 119 filtering escaping vapour. A pressure build up in tank 108 typically happens when the engine is inactive and when the ambient temperature rises. Carbon in canister 112 absorbs the fuel vapour to prevent escape of the fuel vapour to atmosphere and the valve 110 prevents pressure build up in tank 108. When the engine is subsequently started and is running then the depression in the air intake passage downstream of the throttle 101 is used to draw air from atmosphere via the filter 119, the line 118, the canister 112 and purge line 111. This passage of air draws fuel out of the carbon in canister 112 to deliver the fuel to the combustion chamber 10 for combustion. In this way, the carbon is restored to a condition in which the carbon can again absorb fuel vapour. The valve 110 also functions as a "roll over" valve to prevent fuel flowing directly out of the tank 108 to the canister 112 when the engine is tilted or inverted.

The present invention in the manner described above controls emissions of fuel vapour from the fuel tank. A fuel outlet one-way valve of the injector controlling flow of fuel out of the injector prevents emission of fuel vapour from the injector when the fuel injector is inactive.

The pumping section of the fuel injector 107 is located within the fuel tank 108, completely immersed in fuel. Any evaporation of fuel around the fuel injector 107 will lead to fuel vapour that simply rises through the fuel in the fuel tank 108 to the top of the tank 108 to subsequently be purged by the purge line 111. No fuel vapour can build up in the fuel injector 107 and therefore the fuel injector 107 can reliably operate at varying ambient temperatures. This contrasts with the existing design of GB2421543, in which increasing evaporative losses/increasing fuel evaporation affects the amount of fuel delivered by the fuel injector in each stroke because a percentage of a fuel delivery chamber of the injector is filled with fuel vapour rather than liquid fuel. The design of FIG. 1 avoids this by immersing the fuel injector 107 in the fuel in the fuel tank.

It will be seen in FIG. 1 that fuel tank 109 is mounted vertically above the throttle body 100 and that the fuel injector 107 is mounted at the bottom of the fuel tank 108 and then delivers fuel via a fuel nozzle 128 extending downwardly into the intake passage in the throttle body 100. The operation of a fuel injector 107 is controlled by the integrated electronic controller 106.

Figure 2:
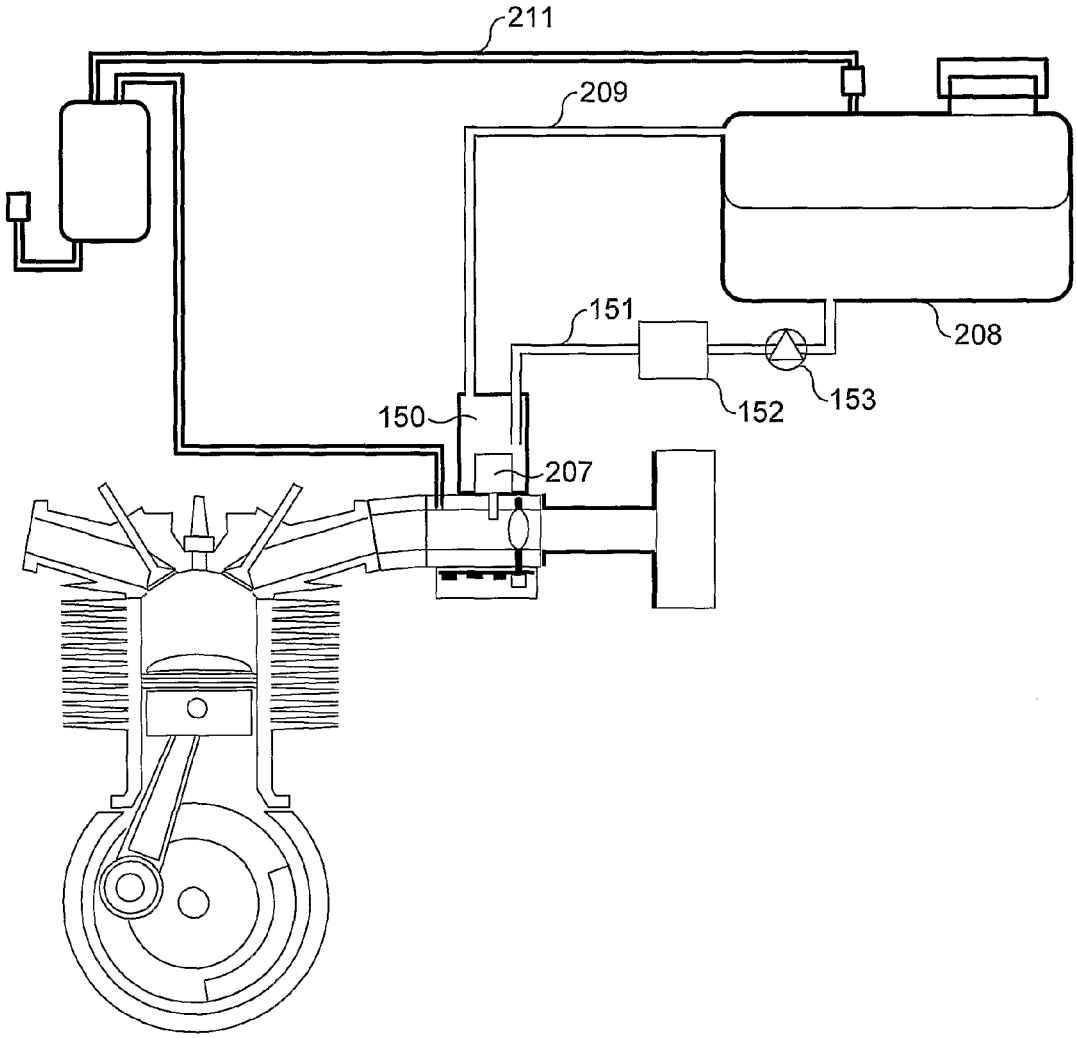
FIG. 2 is a schematic illustration of a second embodiment of internal combustion engine with fuel injection system according to the present invention.

Moving on now to FIG. 2, an arrangement similar to that of FIG. 1 can be seen. The only difference between the two figures is that the fuel injector 207 is no longer mounted in the bottom of the fuel tank 208, but instead is mounted in a separate fuel chamber 150 which is supplied with fuel by a fuel feed pipe 151 leading from the fuel tank 208. A fuel filter 152 is positioned in the fuel feed pipe 151 to prevent impurities reaching the chamber 150. The fuel injector 207 is immersed completely in the fuel in the chamber 150, the fuel chamber 150 being completely full of liquid fuel.

Any evaporation of fuel in the chamber 150 or in the fuel injector 207 will lead to fuel vapour which is returned via a vapour return pipe 209 to the fuel tank 208. The fuel vapour is then purged by the purge line 211.

It may be desirable to include a pump (shown as 153) in the fuel feed pipe 151 to ensure that the fuel chamber 150 remains full and possibly to create a circulation of fuel through the fuel chamber 150 along the vapour return pipe 209 back to the tank 208. However, the pump will not need to be a high pressure pump as is common in the prior art. A low pressure diaphragm pump, which is driven by fluctuations in pressure in the crankcase, would be ideal.

FIG. 3 again shows an arrangement similar to that of FIG. 1, save that in FIG. 3 the fuel tank 308 has a lower portion 308*b* which is elongate in nature and the bulk of the fuel tank, the upper part 308*a*, is spaced vertically further apart from the throttle body 100 than in the FIG. 1 embodiment. The fuel injector 307 is completely immersed in the fuel in the part 308 of the fuel tank 308. Any fuel vapour generated around the fuel injector 307 will escape upwardly to the upper part 308*a* of the fuel tank 308, from where it can be purged by purge line 311, in the manner described in relation to FIG. 1.

Figure 3:
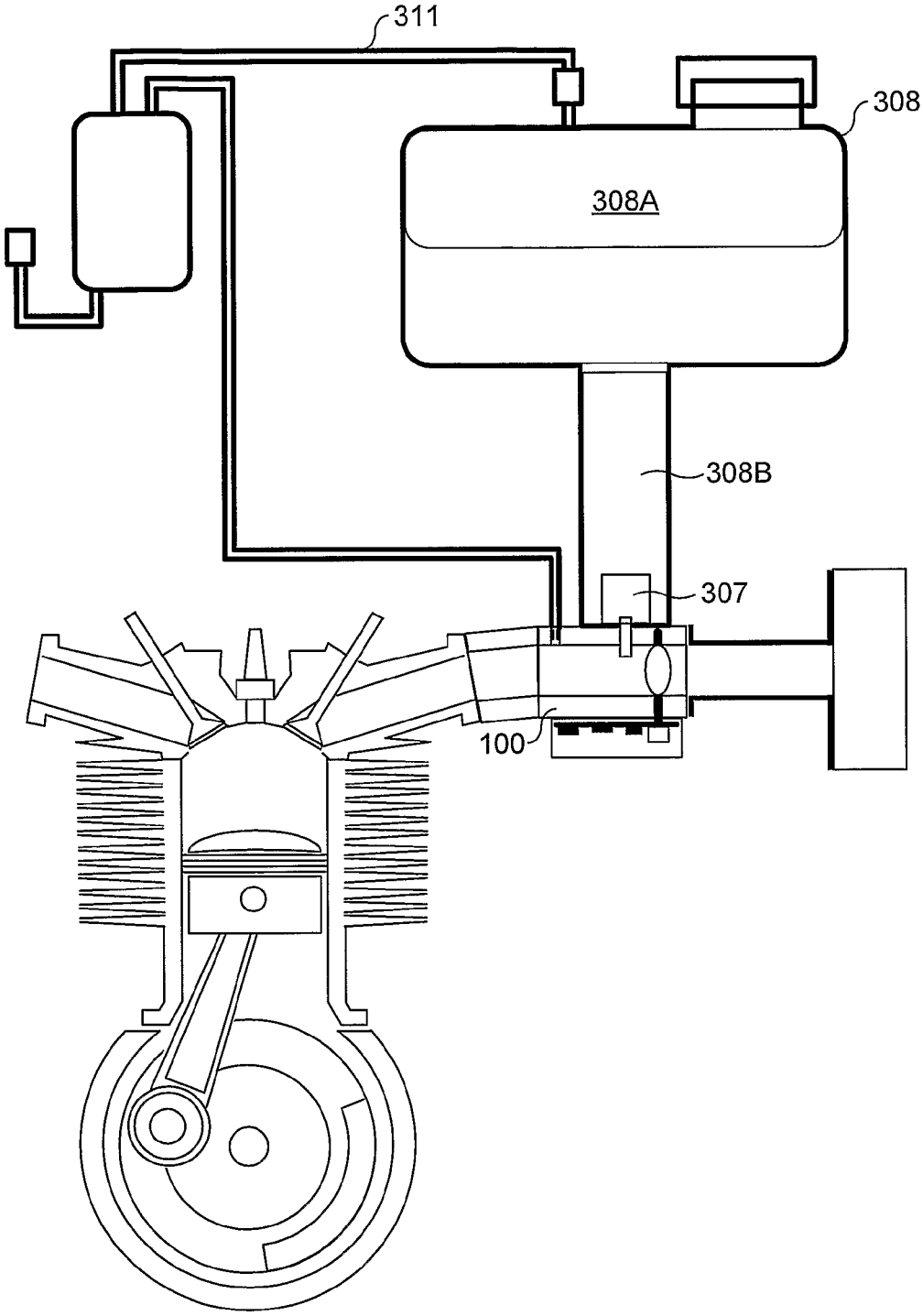
FIG. 3 is a schematic illustration of a third embodiment of internal combustion engine with fuel injection system according to the present invention.

FIG. 3 shows that the fuel tank of the invention can be of various different shapes as required by the packaging requirements of the engine. The main body of the fuel tank can be quite distant from the throttle body 100, with the fuel tank 308 provided with an arm extending from the main body of the fuel tank to the throttle body 100, with the fuel injector mounted at the end of the arm. This is easily possible since fuel tanks are commonly injection- or blow-moulded out of plastic and the plastic moulding process allows the fuel tank to take any desired shape.

It is envisaged that in the systems of FIGS. 1 to 3 the fuel tanks will be separate components to the throttle bodies and these will be separate components to the air filters and the purge line with carbon canister. This need not necessarily be the case and there could be integration of e.g. the fuel tank with the throttle body so that both can be connected into and out of an engine as a complete unit, separately detachable from the remainder of the engine as a single unit. The embodiment of FIG. 4 takes this possibility further and integrates various components in order to make a single unit connectable to and disconnectable from the remainder of the engine, the single unit comprising all the elements needed to form an integrated fuel injection system and air induction system.

Figure 4:
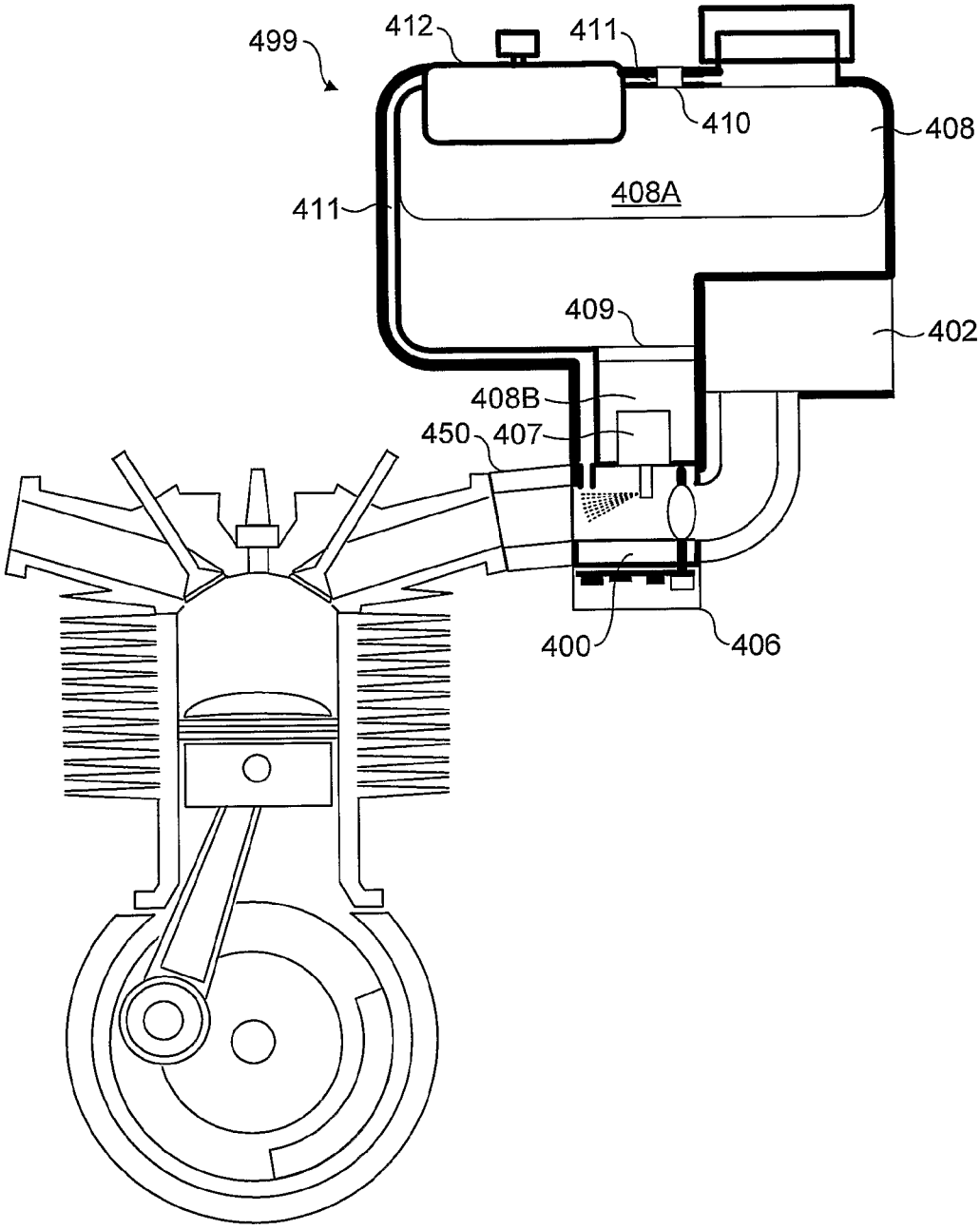
FIG. 4 is a schematic illustration of a fourth embodiment of internal combustion engine with fuel injection system according to the present invention.

In FIG. 4 there is provided a single moulded component 499 which provides a fuel tank 408 having two parts, an upper part 408*a* and a lower part 408*b*, separated by a fuel filter 409. A fuel injector 407 is located in the lower part 408*b* of the fuel tank 408. The throttle body 400 is an integral part of the moulded component 499 illustrated and leads air from an air filter 402 provided in an air filter cavity moulded into the component to a joint 450 where the moulded component 499 is joined to an inlet runner of the engine.

In the moulded component 499 there is also integrally moulded a purge line 411 and cavities for receiving a carbon canister 412 and the roll over and pressure valve 410. The purge line 411 connects the fuel tank 408 to the carbon canister 412 and the carbon canister 412 to the intake passage downstream of the throttle valve.

The integrated electronic controller and sensors 406 are mounted to the bottom of the component 499.

As with the previous embodiments, the fuel injector 407 is completely immersed in gasoline and any fuel vapour will flow to the top of the fuel tank 408 to be removed by the purge line 411.

In the FIG. 4 embodiment, a single moulding provides a cavity for retaining the air filter, the air intake pipe leading from the air filter to the engine, the throttle body, the purge line 411 and cavities for receiving a carbon canister 412 and a valve 410. All of these features can be moulded in the one component to save costs and reduce the complexity of the engine.

Although not illustrated, it is also possible to mould in the component 499 cavities branched off the air intake passage which act as Helmholtz and/or quarter wave tube resonators, to provide tuning of the natural frequency of the air intake system and noise attenuation.

Figure 5:
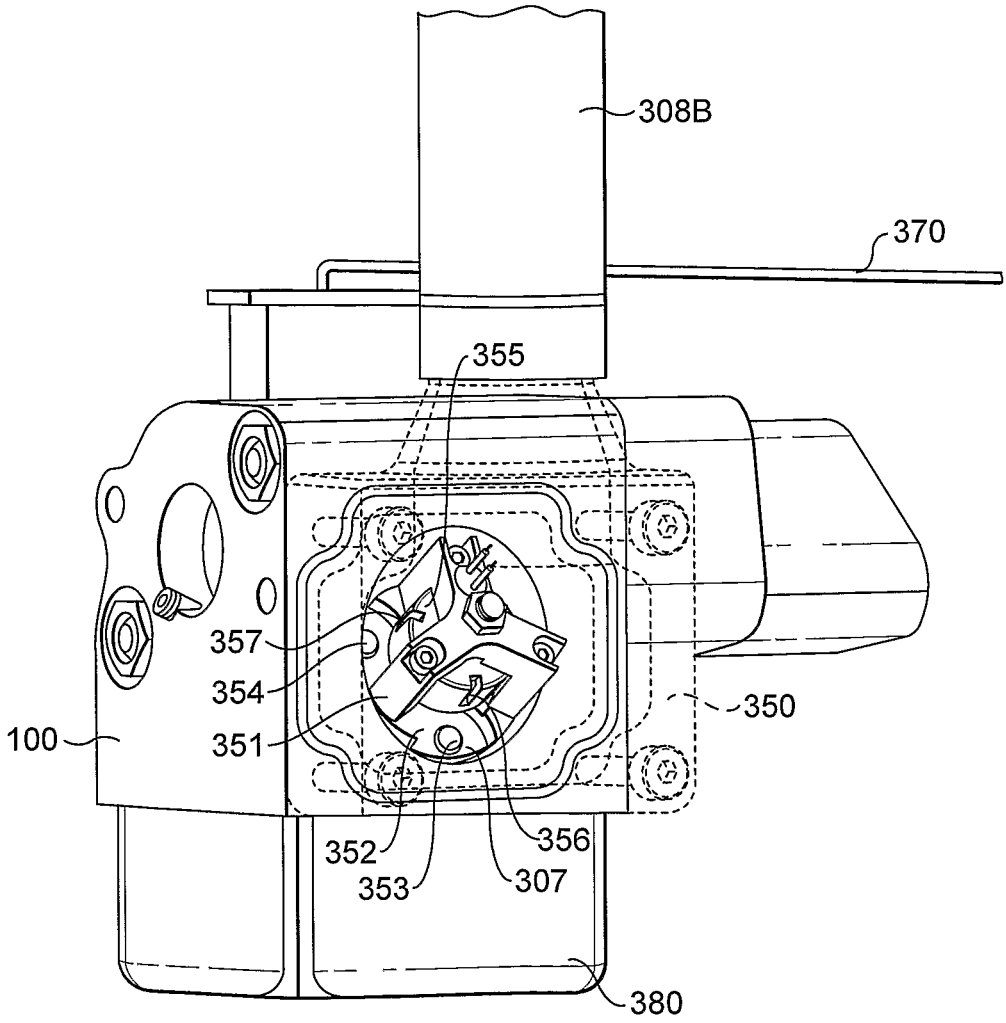
FIG. 5 is a detail view of a fuel injector used in the FIG. 3 embodiment, suitable for use in any of the previously described embodiments.

FIG. 5 is an illustration of the injector of FIG. 3. The arm 308*b* of the fuel tank can be seen extending down to a housing 350 for housing the fuel injector 307. It should be appreciated that FIG. 3 is just schematic and does not shown the detail illustrated in FIG. 5. The two components 308*b* and 350 are shown together as 308*b* in FIG. 3.

In the past, an injector such as injector 307 would have had a cylindrical casing surrounding it entirely, with specific fuel inlet and outlet passages provided through the casing. The present invention does away with this casing and instead has a 3-legged open support frame 351 extending rearwardly from a face plate 352, which in turn allows the injector to be secured to a throttle body 100 by fasteners, illustrated as screws 353 and 354. A casing 355 for an electrical coil of the injector is held in place by the frame 351. Slots 356 and 357 in the casing 355 expose the coil to the surrounding fuel to allow cooling of the coil by the fuel. A piston is slidably located within the coil (not shown in the illustration). The piston will have located within it a one-way inlet valve which will allow fuel to flow into a fuel chamber through an inlet passage passing through the piston, but will then seal off as the piston moves to expel fuel from the fuel chamber. The piston can be moved to expel fuel from the fuel chamber under the action of a biasing spring, then drawing fuel back into the chamber under the action of the electrical coil. Alternatively, the opposite could apply and the piston could expel fuel from the fuel chamber under the action of the electrical coil and then draw fuel into the fuel chamber under the action of the biasing spring.

In the Figure there is shown a linkage 370 by which the throttle blade in the throttle body 100 is rotated within the throttle body. A housing 380 for the electronic circuitry controlling the injector is shown connected to the bottom throttle body 100.

By doing away with the outer casing usually incorporated in a fuel injector, the invention removes an impediment to fluid flow and improves efficiency. The open framework 351 offers little resistance to flow of fuel through to a rear surface of the piston. Also, this reduces the formation of fuel vapour.

Figure 6:
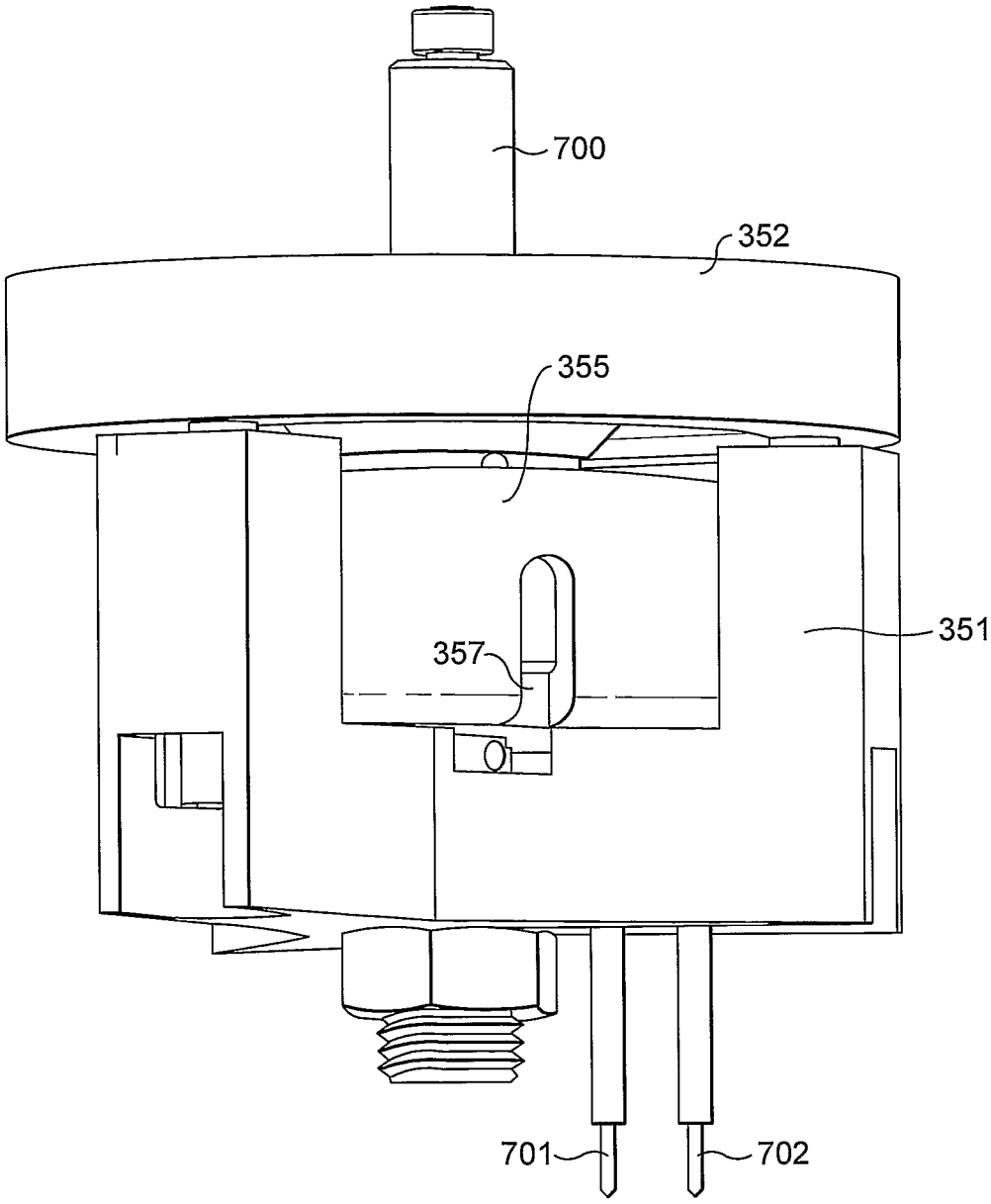
FIG. 6 is a side elevation of the fuel injector of FIG. 5.
Figure 7:
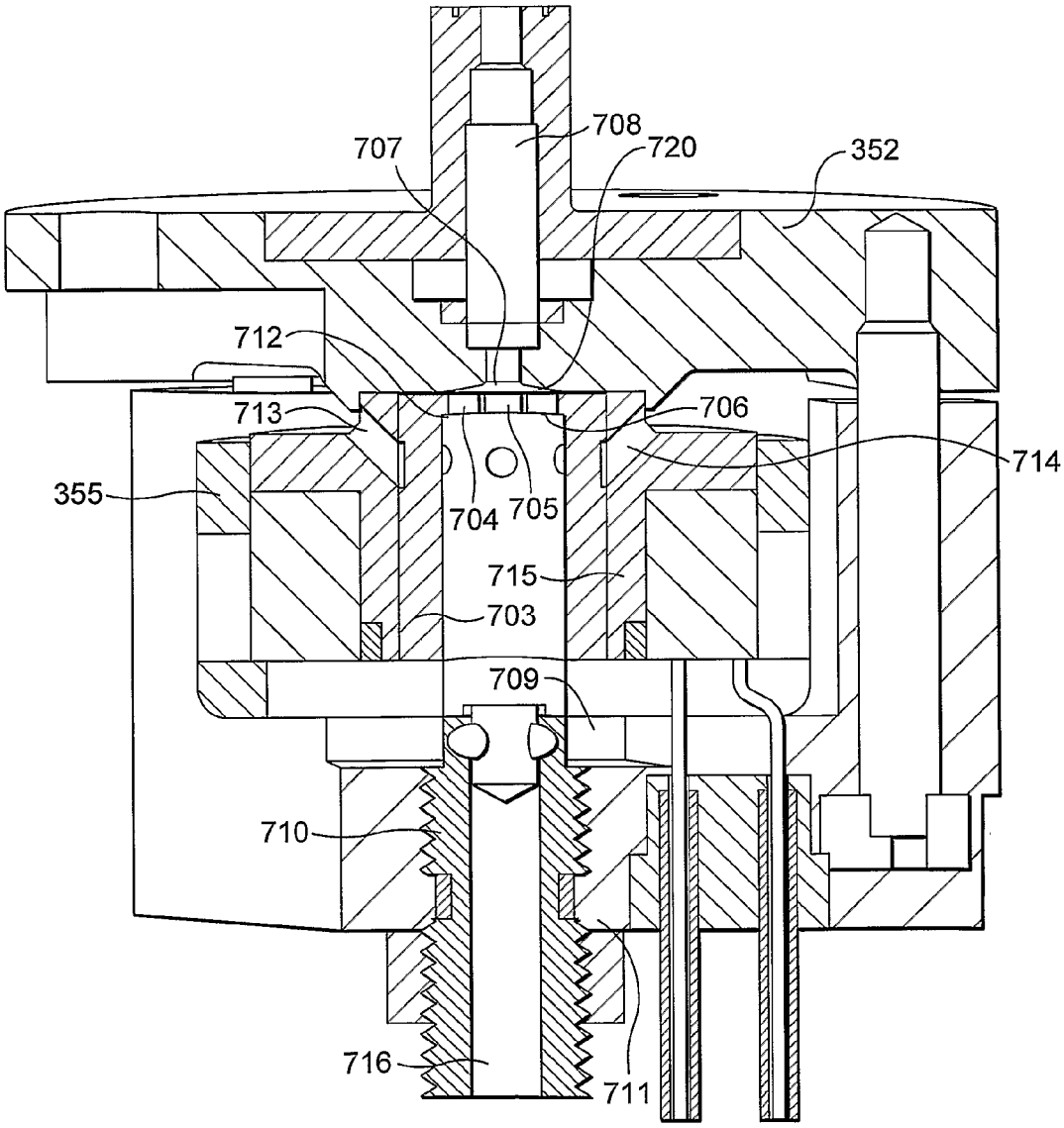
FIG. 7 is a cross-section through the fuel injector of FIGS. 5 and 6.

FIGS. 6 and 7 are respectively an elevation view and a cross-section view of the fuel injector of FIG. 5. FIG. 6 shows the face plate 352 with the three-legged support structure 351 extending therefrom, holding in place the casing 355. The electrical coil can be seen through the slot 357 in the casing. A fuel delivery nozzle 700 (shown as 128 in FIG. 1) can also be seen as well as the electrical wires 701, 702 which allow current to be supplied to the coil.

In FIG. 7 the piston 703 can be seen. A one-way inlet valve (not shown) will control flow of fuel through the apertures 704, 705, 706 in the end of the piston to a fuel chamber 707. A one-way outlet valve (not shown) will control flow of fuel to a fuel delivery passage 708 of the fuel delivery nozzle 700. A spring (not shown) will act between piston 703 and a spring seat 709 provided on an externally threaded member 710, which in turn engages an internally threaded collar 711 and can be rotated to vary pre-load applied by the spring on the piston 703. The coil generates an electromagnetic field which will move piston 703 against a biasing force applied by the spring to draw fuel into the chamber 707. The spring will drive inducted fuel from the fuel chamber to the delivery nozzle. The piston's motion is limited by two end stops and so travel of the piston and the volume of the fuel chamber 707 swept by the piston during motion remains constant for each and every operation of the injector and therefore the injector delivers a set amount of fuel (i.e. a constant fixed volume of volume) in each operation thereof. In every operation the piston will slide between the two end stops to draw in a pre-set volume and then dispense the same volume—the piston does not ever travel less than a fuel stroke when delivering fuel. An end surface 720 of the fuel chamber is conically shaped to smooth flow of fuel out of the chamber 707 through the fuel delivery nozzle.

Fuel can flow to a rear surface 712 of the piston 703 via passages 713, 714 (and others) provided in a cylinder liner 715 and then via radial apertures in the piston 703. Also fuel flows via a passage 716 in the threaded member 700 to the central cylindrical passage in the piston 703. Fuel vapour can also escape this way back to the fuel tank.

The present invention deals with the problem of the formation of fuel vapour in a fuel injection system elegantly by immersing the fuel injector itself in the fuel whilst allowing an escape path for fuel vapour back to the fuel tank, from which it can be removed using the established purge line technology. The invention thus avoids the need for high pressure fuel lines and high pressure fuel pumps. Additionally, the invention takes advantage of the immersion of the injector in gasoline fuel to remove the outer casing which would otherwise be required so that there is an unimpeded flow path of fuel to the rear surface of the piston in the injector. This improves the efficiency of the injector. It also minimises the formation of fuel vapour.

The invention claimed is:

1. An internal combustion engine comprising:

a variable volume combustion chamber;

an air intake passage via which air is delivered to the combustion chamber;

a fuel injector delivering fuel into the air intake passage; and a fuel storage tank for storing fuel to be injected, wherein:

the fuel injector is at least in part immersed in fuel, the fuel injector being located at least in part in a fuel chamber which forms part of the fuel storage tank; and an escape path is provided for escape of fuel vapour from the fuel injector and/or from the proximity of the fuel injector to the fuel storage tank.

2. An internal combustion engine as claimed in claim 1 wherein the fuel storage tank comprises an upper part which stores a majority of the fuel stored when the tank is full and a lower part which provides the fuel chamber and which extends downwardly from the upper storage part to a throttle body forming part of the air intake passage, the fuel injector having a pumping section immersed in the fuel in the lower part of the fuel storage tank and a fuel delivery nozzle extending from the pumping section through a wall of the lower part of the storage tank and a wall of the throttle body into the air intake passage, the escape path for the fuel vapour being provided through the fuel storage tank from the lower part thereof to the upper part thereof.

3. An internal combustion engine as claimed in claim 2 wherein a fuel filter separates the upper and lower parts of the fuel storage tank and filters fuel passing from the upper part to the lower part.

4. An internal combustion engine as claimed in claim 2 wherein the fuel storage tank is a moulded component and the lower part of the fuel storage tank is an integral moulded feature of the storage tank and extends as an elongate arm downwardly away from the upper part of the storage tank.

5. An internal combustion engine as claimed in claim 1 wherein:

a throttle is provided in the throttle body; and a purge line is connected between the upper part of the fuel storage tank and the air intake passage, the purge line opening on the air intake passage downstream of the throttle and allowing fuel vapour to be purged from the fuel storage tank.

6. An internal combustion engine as claimed in claim 1 wherein the fuel injector delivers fuel downwardly into the air intake passage.

7. An internal combustion engine as claimed in claim 1 wherein the fuel storage tank, the fuel chamber and at least a part of the air intake passage are all moulded-in features of a moulded component.

8. An internal combustion engine as claimed in claim 7 wherein the fuel storage tank comprises an upper part which stores a majority of the fuel stored when the tank is full and a lower part which provides the fuel chamber in which the fuel injector is located, the fuel injector having a pumping section immersed in fuel in the lower part and a fuel delivery nozzle extending through a wall which divides the fuel chamber from the moulded-in part of the air intake passage.

9. An internal combustion engine as claimed in claim 8 wherein a purge line is provided as a moulded-in feature of the moulded component, the purge line connecting the upper part of the fuel storage tank to the moulded-in part of the air intake passage and allowing fuel vapour to be drawn out of the upper part of the fuel storage tank.

10. An internal combustion engine as claimed in claim 9 wherein the moulding has a moulded-in carbon canister cavity connected to the purge line and a carbon canister is located in the moulded-in carbon canister cavity and purged fuel vapour drawn from the fuel storage tank passes through the carbon canister.

11. An internal combustion engine as claimed in claim 8 wherein a fuel filter separates the upper and lower parts of the fuel storage tank and filters fuel passing from the upper part to the lower part.

12. An internal combustion engine as claimed in claim 7 wherein the moulding has a moulded-in air filter cavity connected to the moulded-in air intake passage and an air filter is located in the moulded-in air filter cavity for filtering air passing through the air intake passage.

13. An internal combustion engine as claimed in claim 7 wherein the moulding has a moulded-in Helmholtz resonator branched off the moulded-in air intake passage.

14. An internal combustion engine as claimed in claim 7 wherein the moulding has a moulded-in quarter wave tube resonator branched off the moulded-in air intake passage.

15. An internal combustion engine as claimed in claim 1, in which the fuel injector comprises:

a piston;

an electric coil;

a spring;

a fuel dispensing chamber;

a one-way inlet valve admitting fuel into the fuel dispensing chamber;

a one-way outlet valve allowing expulsion of fuel from the fuel dispensing chamber; and a fuel delivery nozzle via which fuel expelled from the fuel dispensing chamber is delivered to the air intake passage, wherein:

the piston sequentially draws fuel into and expels fuel from the fuel dispensing chamber under the action of the electric coil and the spring; and the electric coil and spring are all held in pace in a pumping portion of the fuel injector by an open framework.

16. An internal combustion engine as claimed in claim 15 wherein the one-way inlet valve is located in the piston and controls flow of fuel through a fuel transfer passage passing through the piston.

17. An internal combustion engine as claimed in claim 16 wherein the piston has a plurality of apertures therethrough which allow flow of fluid from outside to the piston to a closed bore in the piston having an end face from which the fuel transfer passage extends through the piston.

18. An internal combustion engine as claimed in claim 15 wherein the piston reciprocates between two end stops which constrain travel of the piston to a set distance in each operation of the fuel injector, whereby a volume of the fuel dispensing chamber swept in each operation of the fuel injector is fixed.

19. An internal combustion engine as claimed in claim 15 wherein the electric coil is encased by casing which has slots to allow access of fuel to the electric coil to cool the coil.

20. An internal combustion engine as claimed in claim 15 wherein the fuel injector comprises an open framework holding in place:

a cylinder lining defining a cylinder in which the piston reciprocates; and a casing for the electric coil.

21. An internal combustion engine as claimed in claim 20 where the open framework is a three-legged frame.

* * * * *